United States Patent [19]

Takahama et al.

[11] Patent Number: 5,067,288

[45] Date of Patent: Nov. 26, 1991

[54] DOME STRUCTURE

[75] Inventors: Yoshihiro Takahama; Kazushige Kurihara; Takayuki Nishiya, all of Tokyo, Japan

[73] Assignee: Shimizu Construction Co., Ltd., Tokyo, Japan

[21] Appl. No.: 523,720

[22] Filed: May 15, 1990

[30] Foreign Application Priority Data

May 16, 1989 [JP] Japan ..... 1-122637

[51] Int. Cl.[5] ..... E04B 01/32

[52] U.S. Cl. ..... 52/80; 52/81

[58] Field of Search ..... 52/80, 81

[56] References Cited

U.S. PATENT DOCUMENTS 3,328,820 6/1967 Braccini ..... 52/81 X 3,888,056 6/1975 Kelly et al. ..... 52/81 X

FOREIGN PATENT DOCUMENTS 426201 6/1967 Switzerland ..... 52/80

0827718 5/1981 U.S.S.R. ..... 52/80

OTHER PUBLICATIONS

Interbuild, "*New Buildings*", Sep. 1961, pp. 33–35.

"Prestressing Prevents Flutter of Cable Roofs", by Seymour Howard, Aug. 1959.

*Primary Examiner*—Richard E. Chilcot, Jr.

*Assistant Examiner*—Lan Mai

*Attorney, Agent, or Firm*—Scully, Scott, Murphy & Presser

[57] ABSTRACT

A dome structure is disclosed, comprising an upper part of a dome structure having a top portion and a bottom portion and being erected on a structure with the bottom portion of the dome frame contacting the structure, the dome structure comprising a plurality of arch-shaped steel trusses, each of which comprises a plurality of upper chord members and a plurality of lower chord members; and at least two pairs of compression rings, each ring in a pair being of a different diameter and being engaged with the top portion of the dome structure, at least the pairs of the compression rings supporting the upper chord members, and one of the rest of the pairs of the compression rings supporting the lower chord members, the steel trusses extending radially from the compression ring to the structure.

5 Claims, 3 Drawing Sheets

DOME STRUCTURE

BACKGROUND OF THE INVENTION

1. Field of the Invention

The present invention relates to dome structures which are suitable for use in structures such as multipurpose stadiums.

2. Background of the Invention

FIG. 1 shows a conventional dome structure generally used for the domes of multipurpose stadiums, auditoriums, etc.

The dome structure comprises arch-shaped steel trusses 3 which are erected from an upper part of a stadium 1 toward its top 2. At the top 2, a compression ring 4 is provided so as to improve the adjustment of the end of each of the trusses.

Usually, the compression ring 4 is formed by respective ends of an upper chord 5 and a lower chord 6 which form the trusses 3, and a pair of rings 7 which pass through the respective ends once.

However, the dome frame having the above-described conventional construction is disadvantageous in that the effect of the compression ring 4 is insufficient. This is because when the compression ring 4 is formed by the single ring 7, the moment $M_1$ induced by the self-load of the dome frame itself (uniformly distributed load P) is similar to the moment induced by the steel trusses 3 alone without the compression rings 4, as shown in FIG. 2.

SUMMARY OF THE INVENTION

Therefore, it is an object of the present invention to improve the conventional compression ring and provide a dome structure which can decrease the moment induced by the dome structure itself and which can be manufactured inexpensively.

The present invention provides an overhead constructed dome structure, comprising:

(a) an upper part of a dome structure having a top portion and a bottom portion and being erected with the bottom portion of the dome structure contacting the upper surface of a base structure on which it is erected, the dome frame comprising a plurality of arch-shaped steel trusses, each of which comprises a plurality of upper chord members and a plurality of lower chord members; and (b) at least two pairs of compression rings, each ring in a pair being of a diameter different from the other and being engaged with the top portion of the dome frame, at least one of the pairs of the compression rings supporting the upper chord members, and one of the remaining pairs of the compression rings supporting the lower chord members, the steel trusses extending radially from the compression ring to the base structure.

According to the present invention, a dome having an economical steel truss cross-section can be realized which has improved stability of the top portion thereof and which can reduce not only the moment applied to the steel trusses but also deformation due to external forces.

DESCRIPTION OF THE PREFERRED EMBODIMENTS

Hereafter, the present invention will be described in detail with reference to the attached drawings, in which FIGS. 3 to 6 show a dome frame according to a preferred embodiment of the present invention. In FIGS. 3 to 6, the parts or members which are the same as those used in the prior art are indicated by the same numerals.

Figure 1:
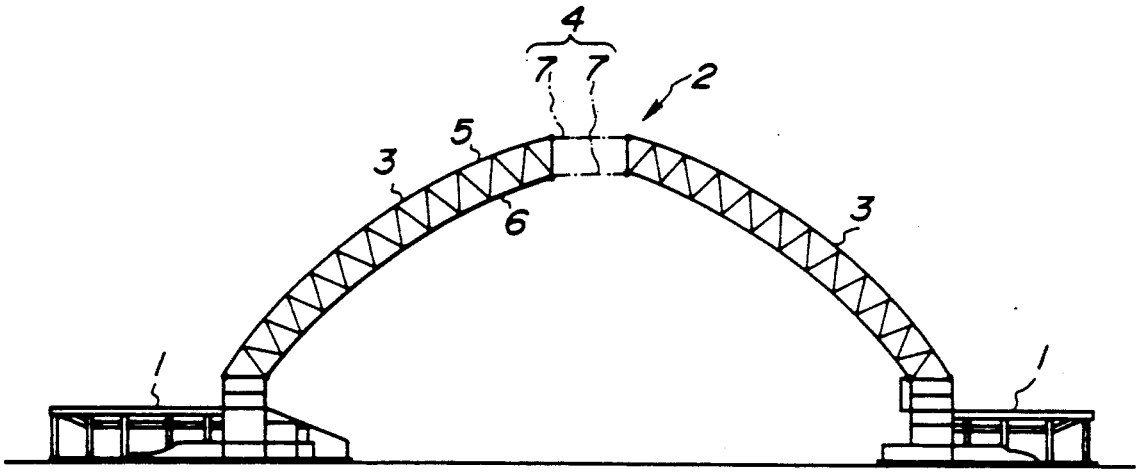
FIG. 1 (PRIOR ART)
FIG. 1 is a cross-sectional view of a conventional dome structure.
Figure 2:
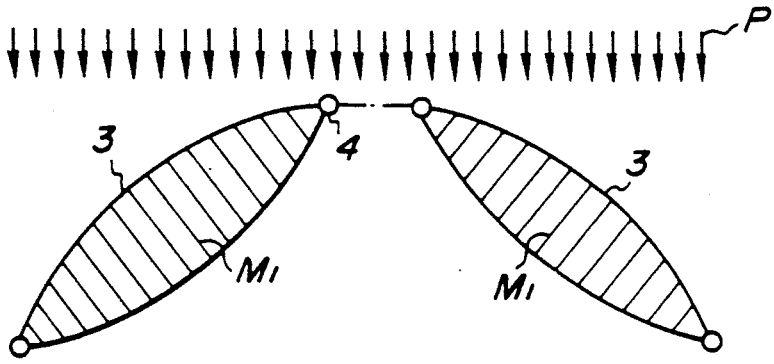
FIG. 2 (PRIOR ART)
FIG. 2 is a diagram of the conventional frame shown in FIG. 1. showing the moments.
Figure 3:
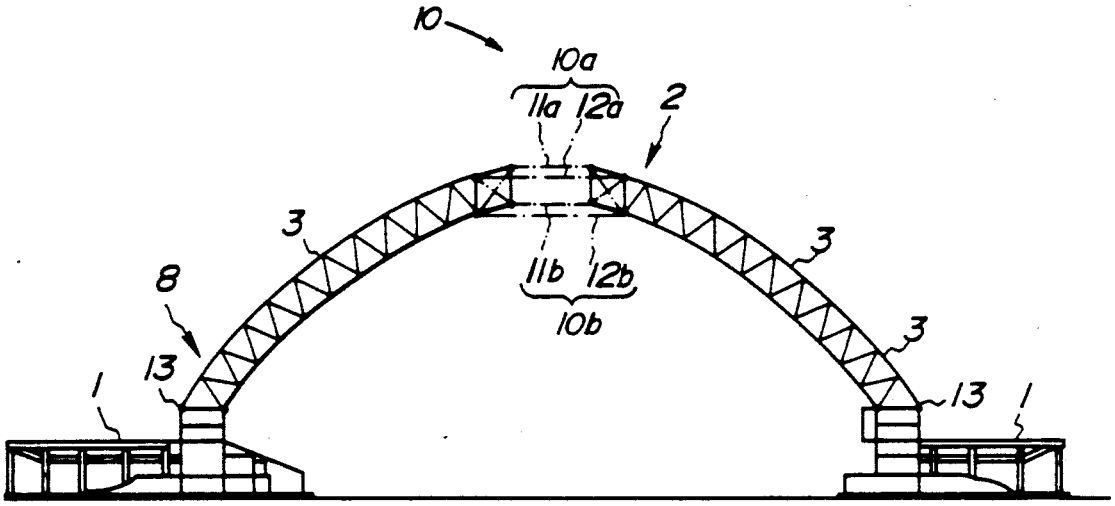
FIG. 3 is cross-sectional view of the dome structure according to a preferred embodiment of the present invention.
Figure 4:
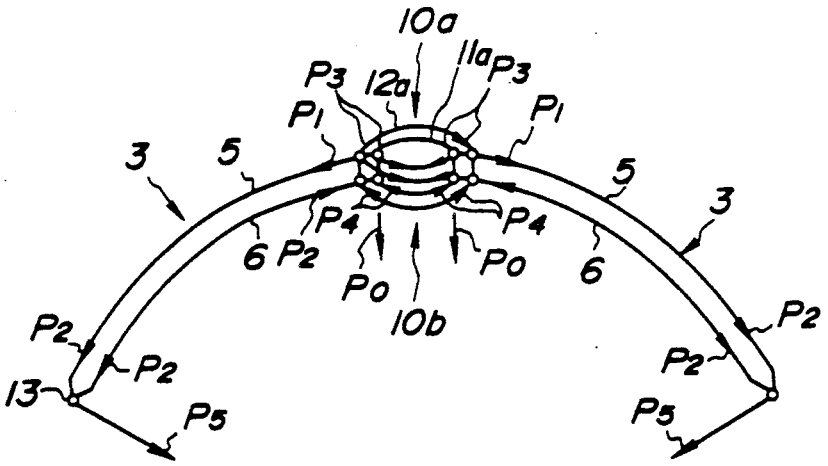
FIG. 4 is a schematic diagram of a dome structure showing the forces acting in the dome structure.
Figure 5:
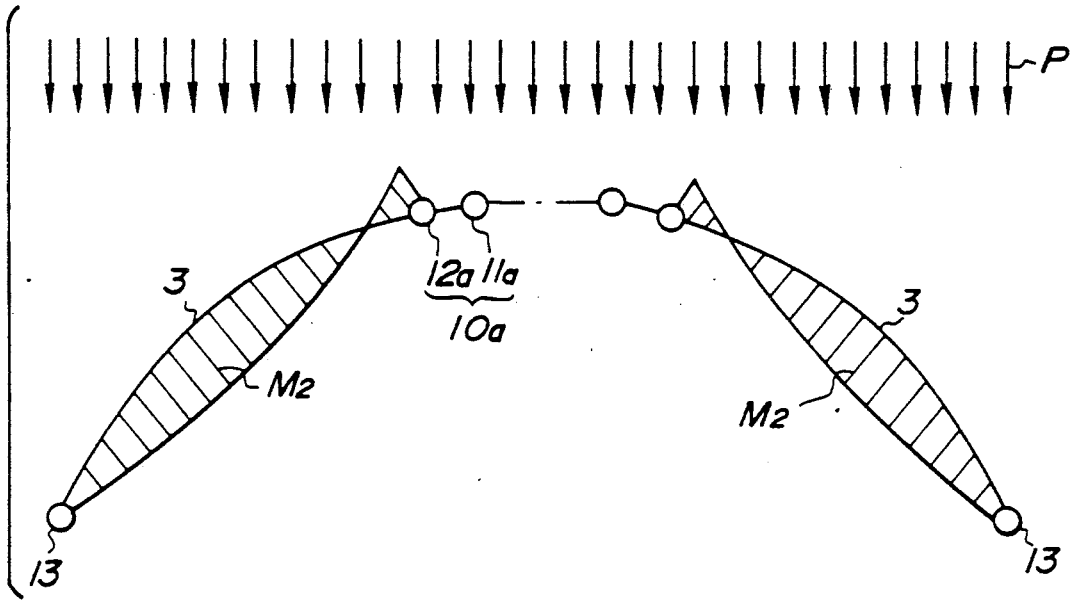
FIG. 5 is a diagram illustrating the distribution of moments applied to a dome structure according to a preferred embodiment of the present invention.
Figure 6:
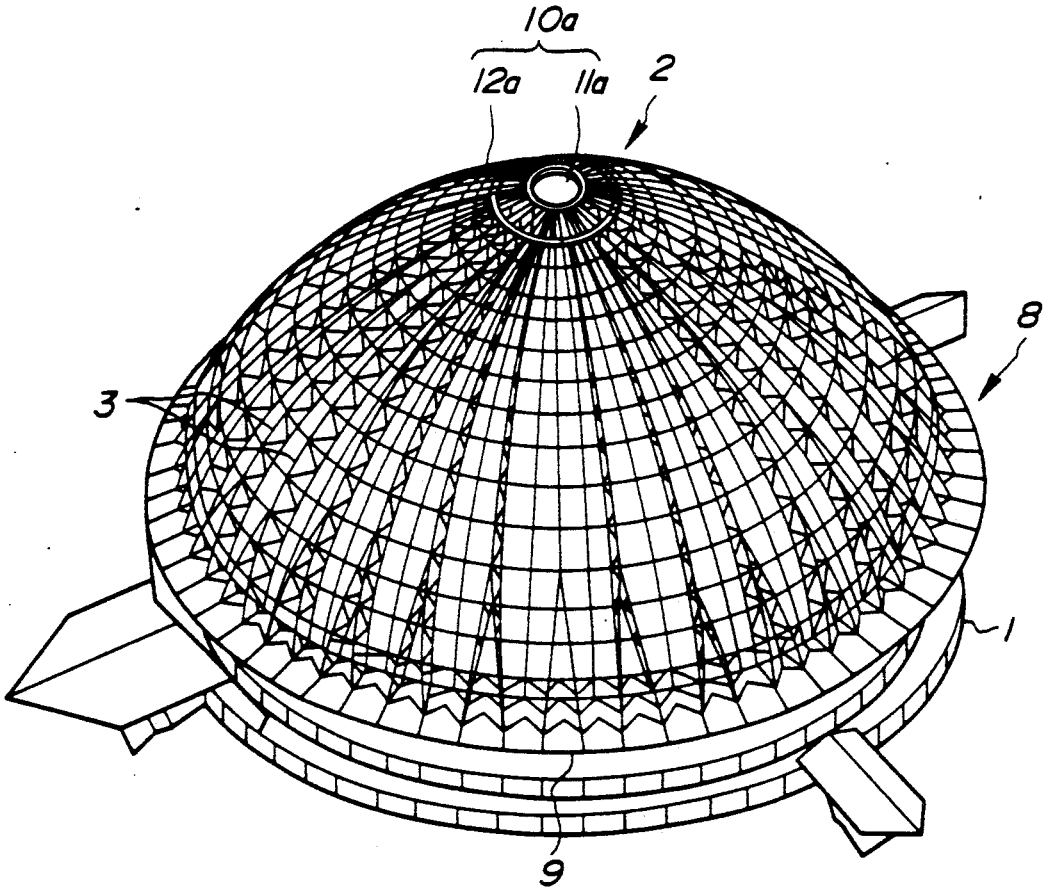
FIG. 6 is a perspective view of a dome structure according to a preferred embodiment of the present invention.

As shown in FIG. 3 in cross-section, the dome structure is constructed of a plurality of arch-shaped steel trusses 3 which are erected on a circular structure 1 such as a stand or the like so that the bottom portion of the dome structure can contact the structure, and extends radially toward the top portion 2 of the dome structure, and a compression ring assembly 10 provided in the top portion 2 of the dome frame positioned toward the end of each of the steel trusses 3.

The compression ring assembly 10 is comprised of at least two pairs of rings, a first or upper pair 10*a* and a second or lower pair 10*b*. The first pair of rings 10*a* includes rings 11*a* and 12*a*, and the second pair of rings 10*b* includes rings 11*b* and 12*b*. Ring 11*a* has a diameter different than the diameter of ring 12*a*, and both of these rings are engaged with an upper chord member 5 of each of the steel trusses 3. Also, ring 11*b* has a diameter different than the diameter of ring 12*b*, and both of these rings are engaged with a lower chord member 6 of each of the steel trusses. As shown in the moment-distribution diagram illustrated in FIG. 5, the upper member (i.e., the upper chord member 5) is under tension since a lifting moment is applied thereto. As the result, as shown in the construction model diagram illustrated in FIG. 4, tensile force $P_1$ and compression force $P_2$ are generated at the tops of the upper chord member 5 and the lower chord member 6, respectively, due to vertical load $P_0$ exerted by the self-load of the dome frame itself, and these forces balance tensile force $P_3$ and compression force $P_4$ generated by the compression rings 10*a* and 10*b*, respectively. Therefore, the tensile stress and compression stress produced by each of the steel trusses 3 are separately contained by the double compression ring, i.e , the upper compression ring 10*a* and the lower compression ring 10*b*, so that the intensity of the stress applied to each of the ring members 11 and 12 can be reduced.

Furthermore, by making the compression ring assembly 10 of a double construction, the extent to which the top portion 2 of the steel truss 3 is fixed to the compression ring 10 (i.e., the ring members 11*a*, 12*a*, 11*b*, and 12*b*) can be increased, and a continuous-beam effect is thereby exhibited. The result is that the maximum moment $M_2$ applied to the dome structure by its own load (uniformly distributed load P) can be decreased as shown in the moment diagram in FIG. 5. As a result, the stresses applied to the ring members 11*a*, 12*a*, 11*b*, and 12*b* can be reduced, and in addition, deformation of the entire dome structure can be reduced, thus allowing steel trusses 3 to be of an economically advantageous cross section.

Around peripheral portions 8 of the respective steel trusses 3 are provided tension rings 13 which are to be engaged with the upper periphery of the structure 1, thus providing a structure in which tensile force $P_2$ generated in the peripheral portion 8 by the vertical load $P_0$ (expansion force) exerted on each of the steel trusses 3 is in balance with tensile force $P_5$ from the tension ring 13. As stated above, the dome structure constructed by the steel trusses 3, the compression ring 10 and the tension ring 13 is of a self balancing-type construction in which the force generated by the steel trusses 3 is uniformly balanced by the compression ring assembly 10 and the tension ring 13, thus creating a structure in which the thrust force exerted by the steel trusses 3 can be prevented from being transmitted to the structure 1.

The dome frame of the above-described construction may be covered by a polytetrafluoroethylene membrane, or the like, over all of the outer surface of the steel trusses 3, to form a roof. In this case, the compression ring assembly 10 may be provided with, for example, lighting fixtures, or the ring may form a ventilation opening.

According to the above-described embodiment of the present invention, the following effects are obtained.

(1) Since the dome frame is of a self-balancing-type construction, there are provided not only a balanced plurality of the arch-shaped steel trusses 3 erected on the structure 1, a compression ring assembly 10 engaged with the top portions of the respective steel trusses 3, and a tension ring 13 at the peripheral portion of each of the steel trusses 3, but also the forces exerted on the respective steel trusses 3 are distributed uniformly by the respective rings 10 and 13. The thrust force exerted on the steel trusses 3 is not transmitted to the underlying structure 1, which is economically advantageous.

(2) Use of two pairs of compression rings 10*a* and 10*b* of a double construction, each composed of two rings having diameters different from each other and the provision of the two compression rings 10*a* and 10*b*, the upper and lower ones, on the tops of the upper chord member 5 and the lower chord member 6, respectively, makes it possible to separately transmit the compression stress and the tensile stress from the respective steel trusses 3 to the ring members 11*a*, 11*b*, 12*a*, 12*b*, respectively, thus reducing the stress applied to each of the ring members 11*a*, 11*b*, 12*a*, and 12*b*. In addition, it is possible to provide a construction which is highly resistant to deformation due to external forces.

What is claimed is:

1. A dome structure, comprising:

a base;

an upper assembly erected on and extending upward and inward from the base, and including i) a bottom section contacting and supported by the base, and ii) a plurality of arch-shaped steel trusses connected to and extending upward and inward from said bottom section, each of the trusses including an upper end portion, a plurality of upper chord members and a plurality of lower chord members; and a ring assembly engaging and supporting the upper end portions of the trusses, and including at least upper and lower pairs of rings engaging upper end portions of the trusses, and wherein i) each ring of each of said pairs has a diameter different than the diameter of the other ring of the pair, ii) the rings of the upper pair of rings are connected to and support the upper chord members, and iii) the rings of the lower pair of rings are connected to and support the lower chord members.

2. A dome structure according to claim 1, wherein each of the trusses further includes a lower, peripheral end portion;

the upper assembly further includes a tension ring connected to the lower peripheral end portions of the trusses.

3. A dome structure according to claim 2, wherein the tension ring engages the base and prevents thrust forces exerted by the trusses from being transmitted to the base.

4. A dome structure comprising:

a base;

an upper assembly erected on an extending upward and inward from the base, and including i) a bottom section contacting and supported by the base, and ii) a plurality of arch-shaped steel trusses connected to and extending upward and inward from said bottom section, each of the trusses including an upper end portion, a plurality of upper chord members and a plurality of lower chord members; and a ring assembly engaging and supporting the upper end portions of the trusses, and including at least upper and lower pairs of rings engaging upper end portions of the trusses, the upper pair of rings including a first ring and a second ring, each of the first and second rings being connected to and supporting the upper chord members, each of the first and second rings having a diameter, and the diameter of the first ring being different than the diameter of the second ring;

the lower pair of rings including a third ring and a fourth ring, each of the third and fourth rings being connected to and supporting the lower chord members, each of the third and fourth rings having a diameter, and the diameter of the third ring being different than the diameter of the fourth ring.

5. A dome structure according to claim 4, wherein:

the diameter of the second ring is larger than the diameter of the first ring;

the second ring is located below and is concentric with the first ring;

the diameter of the fourth ring is larger than the diameter of the third ring; and the fourth ring is located below and is concentric with the third ring.

* * * * *

UNITED STATES PATENT AND TRADEMARK OFFICE

CERTIFICATE OF CORRECTION

PATENT NO. : 5,067,288

DATED : November 26, 1991

INVENTOR(S) : Yoshihiro Takahama, et al.

It is certified that error appears in the above-identified patent and that said Letters Patent is hereby corrected as shown below:

Column 3, line 7: "$P_2$" should read as --$P_2'$--

Signed and Sealed this

Thirteenth Day of April, 1993

*Attest:*

STEPHEN G. KUNIN

*Attesting Officer*

*Acting Commissioner of Patents and Trademarks*